US006161319A

United States Patent [19]

Rink et al.

[11] Patent Number: 6,161,319

[45] Date of Patent: Dec. 19, 2000

[54] ROTATABLE AND ILLUMINATED DISPLAY DEVICE

[76] Inventors: Andreas Rink, Am Steinweg 10, D-61130 Nidderau, Germany; Klaus Illmann, Barbarasti 3, D-08058 Zwickau, Germany

[21] Appl. No.: 09/377,404

[22] Filed: Aug. 20, 1999

[30] Foreign Application Priority Data

Aug. 21, 1998 [DE] Germany ..... 298 15 073 U

[51] Int. Cl.[7] ..... G09F 13/00; G09F 13/30

[52] U.S. Cl. ..... 40/502; 40/432; 362/812; 362/428

[58] Field of Search ..... 40/431, 432, 502, 40/564; 362/427, 428, 431, 432, 812

[56] References Cited

U.S. PATENT DOCUMENTS

| | | | |
|---|---|---|---|
| 1,637,988 | 8/1927 | Egan | 40/502 X |
| 1,697,753 | 1/1929 | Cannon | 40/502 |
| 1,737,030 | 11/1929 | Stephens | 40/432 |
| 1,957,763 | 5/1934 | Dupler | 40/431 |
| 2,280,684 | 4/1942 | Bronner, Sr. | 40/431 |
| 2,427,655 | 9/1947 | Blankenship | 40/502 X |
| 3,247,609 | 4/1966 | Hayes et al. | 40/431 |
| 3,377,728 | 4/1968 | Miller, Jr. | 40/595 |

FOREIGN PATENT DOCUMENTS

| | | |
|---|---|---|
| 82352577 | 6/1983 | Germany . |
| 93153333 | 2/1994 | Germany . |

*Primary Examiner*—Brian K. Green
*Attorney, Agent, or Firm*—Dennison, Scheiner, Schultz & Wakeman

[57] ABSTRACT

A lighted, rotatable display device for presenting advertising or other information is disclosed which includes a hollow transparent member supported for rotation on a drive motor. The drive motor includes a shaft extending into the hollow member and a light bulb is mounted on the shaft. Light from the light bulb makes information on the surface of the hollow member visible as the hollow member rotates.

9 Claims, 4 Drawing Sheets

ROTATABLE AND ILLUMINATED DISPLAY DEVICE

FIELD OF THE INVENTION

The invention relates to a device for presenting information, in particular advertising texts and/or advertising graphics, comprising a body which can be driven around an axis of rotation by means of a drive and having a surface for reproducing the information, wherein a light source is arranged in the interior of the body.

BACKGROUND OF THE INVENTION

Such a device is known from DE 295 00 392 U1. A cylindrical advertising carrier is described in DE 295 00 392 U1, the interior of which is illuminated and which is rotatable. The cylindrical advertising carrier is arranged, rotatable around a fixed column, and its underside rests on rollers, of which at least one roller is driven. At least one light source is arranged on a column extending in the interior of the cylinder.

One the one hand, the seating of the cylindrical body in the column is awkward, and on the other hand, even illumination of the surface showing the information cannot be achieved by means of the light source which is attached to the column in the longitudinal direction.

SUMMARY OF THE INVENTION

Based on the above, it is the object of the present invention to solve the problem of further developing a device for the presentation of information in such a way, that it has a simple and cost-effective construction and by means of which the advertising surface is illuminated evenly when viewed from all sides.

In accordance with the invention, this object is attained in that a driveshaft of the drive extends along the axis of rotation, and that, for the even illumination of the surface presenting the information, the light source is arranged on the course of the axis of rotation essentially in the center of the body. Since the driveshaft is directly connected with the surface of the body, a direct force transfer is achieved. The body is also seated directly by means of the driveshaft, so that further bearing elements are not required. An even illumination of the surface is achieved by means of the arrangement of the light source in the center of the body.

In connection with a particularly preferred embodiment it is provided that the body is a thin-walled hollow sphere, preferably made of a transparent plastic material, wherein a point-shaped light source, such as an incandescent lamp, is arranged in the center of the hollow sphere. A spherical advertising carrier is particularly distinguished by an even illumination of the advertising surface. Moreover, the spherical shape is an eye catcher, which can be used as a special advertising effect.

In order to be able to produce the highest number of pieces of advertising-neutral bodies, it is provided that information carriers, such as advertising texts and/or advertising graphics can be applied to the surface of the body at a later time, wherein the information bodies are preferably designed as transparent adhesive foils, which can be glued to the surface of the body. When the body is designed as a thin-walled hollow sphere, a multitude of information carriers is glued to the surface, wherein the individual information carriers are embodied as strips, which taper to a point in the direction toward the imagined penetration points of the axis of rotation.

In connection with large numbers, a particularly preferred embodiment is distinguished in that the surface of the body consists of a thin-walled, sturdy and transparent layer of plastic, wherein the advertising text and/or the advertising graphics are an integral component of the surface, i.e. they are formed in it.

In accordance with the invention, the drive of the device is designed as a motor/gear unit, wherein the driveshaft, which is preferably enclosed in a protective tube, extends from the gear, and a flange for fastening the body is arranged at its end, and wherein a holder for the light source extends coaxially with the driveshaft and extends through an opening in the surface of the body into the interior of the body.

This embodiment is particularly distinguished in that the driveshaft extending from the gear also is a seat for the advertising body at the same time. A particularly simple arrangement is made possible by means of the holder for the light source, which extends coaxially with the driveshaft. It is provided here that the holder for the light source is a tube extending inside the driveshaft and arranged fixed in place.

The electrical feed lines for the light source can be safely placed inside the tube.

To achieve a dependable energy supply of the light source when the advertising body is turning, it is provided that the light source is supplied with electrical energy via wiper contacts.

The motor/gear unit is embodied in such a way that the body can be rotated in two directions. Rotating speeds of approximately 6 rpm are attained here.

The device for presenting information has been designed particularly for use outside. To this end it is provided that the holder is designed as a wall-mounted holder wherein, extending from a fastening plate in the wall, a curved support, such as an essentially horizontally extending steel pipe with a receiving plate for the motor/gear unit, whose axis of rotation extends essentially vertically, is arranged at a distance from the wall.

Alternatively, there is the option of presenting the advertising body in the manner of a floor lamp, wherein the holding device is preferably designed as a vertically extending support pipe, on whose bottom end a solid foot resting on the ground is arranged, and on its top a receiving plate for the motor/gear unit.

In connection with a further embodiment it is provided that the advertising body for displaying a mobile object, such as a motor vehicle or the like, can be placed at a distance and preferably perpendicularly above the object by means of a holding device. In this case the holding device has a stand at the bottom, which is arranged next to or under the object to be advertised, and wherein, starting at the stand, a support device extends, preferably in an arc, on which an essentially horizontally extending receiving plate for the motor/gear unit is provided above the object for fastening the advertising body.

Further details, advantages and characteristics of the invention ensue not only from the claims, the characteristics to be found therein—by themselves and/or in combination—, but also from the following description of preferred embodiments to be taken from the drawings.

BRIEF DESCRIPTION OF THE DRAWINGS

Shown are in.

DETAILED DESCRIPTION OF THE PREFERRED EMBODIMENTS

Figure 1:
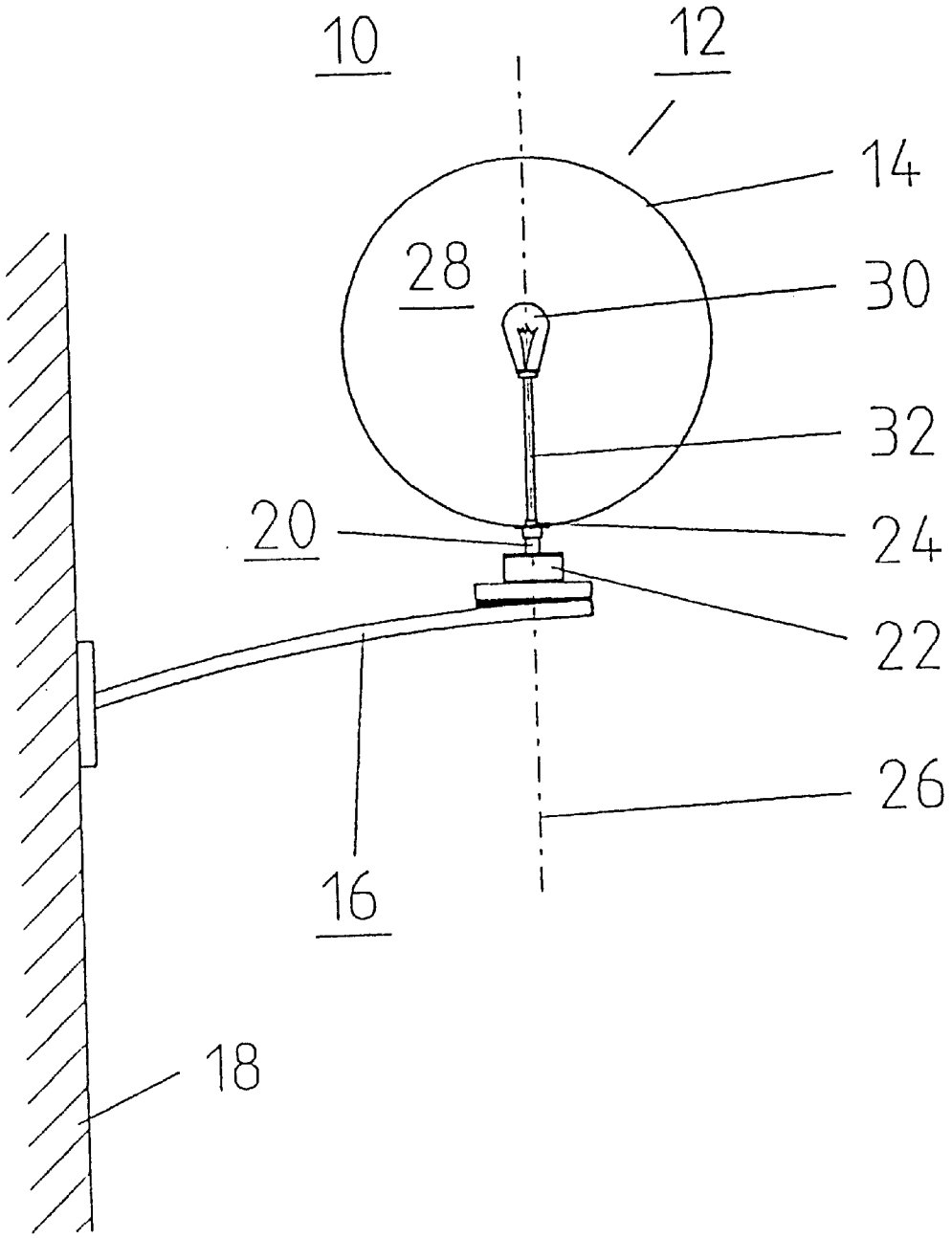
FIG. 1, a lateral view of the presentation device in a sectional view.

A lateral view of a device 10 for presenting information, in particular advertising texts and/or advertising graphics, is represented in a sectional view in FIG. 1. The device 10 consists of a body 12 with a surface 14, on which the information is represented, and which is fastened by means of a holding device 16 on a structure 18, for example a wall. In the exemplary embodiment represented here, the body is designed as a thin-walled hollow sphere, wherein the surface 14 is made of a thin-walled transparent plastic material. Other body shapes, for example cuboids, cubes, ellipses or the like, can also be used.

The body 10 is connected by means of a drive 20 with the holding device 16. The drive 20 itself consists of a motor/gear unit 22, starting from which a driveshaft 24 extends along an axis of rotation 26. The body 12 can be turned in arbitrary directions around the axis of rotation 26 by means of the drive 20.

In order to achieve an even illumination of the surface 14 of the body 12, a light source 30 is arranged in the interior 28, preferably in the center of the body 12. The light source is arranged at the end of a holder 32, which also extends along the axis of rotation 26 and coaxially in respect to the driveshaft 24.

For presenting advertising, the surface 14 of the body 12 can be provided with information carriers, such as stickers. In order to achieve sufficient and even illumination, the stickers should be transparent. As a alternative, the information, i.e. the advertising text and/or the advertising graphics, can be worked into the surface 14, or respectively the plastic material constituting the surface 14, as an integral component.

Figure 2:
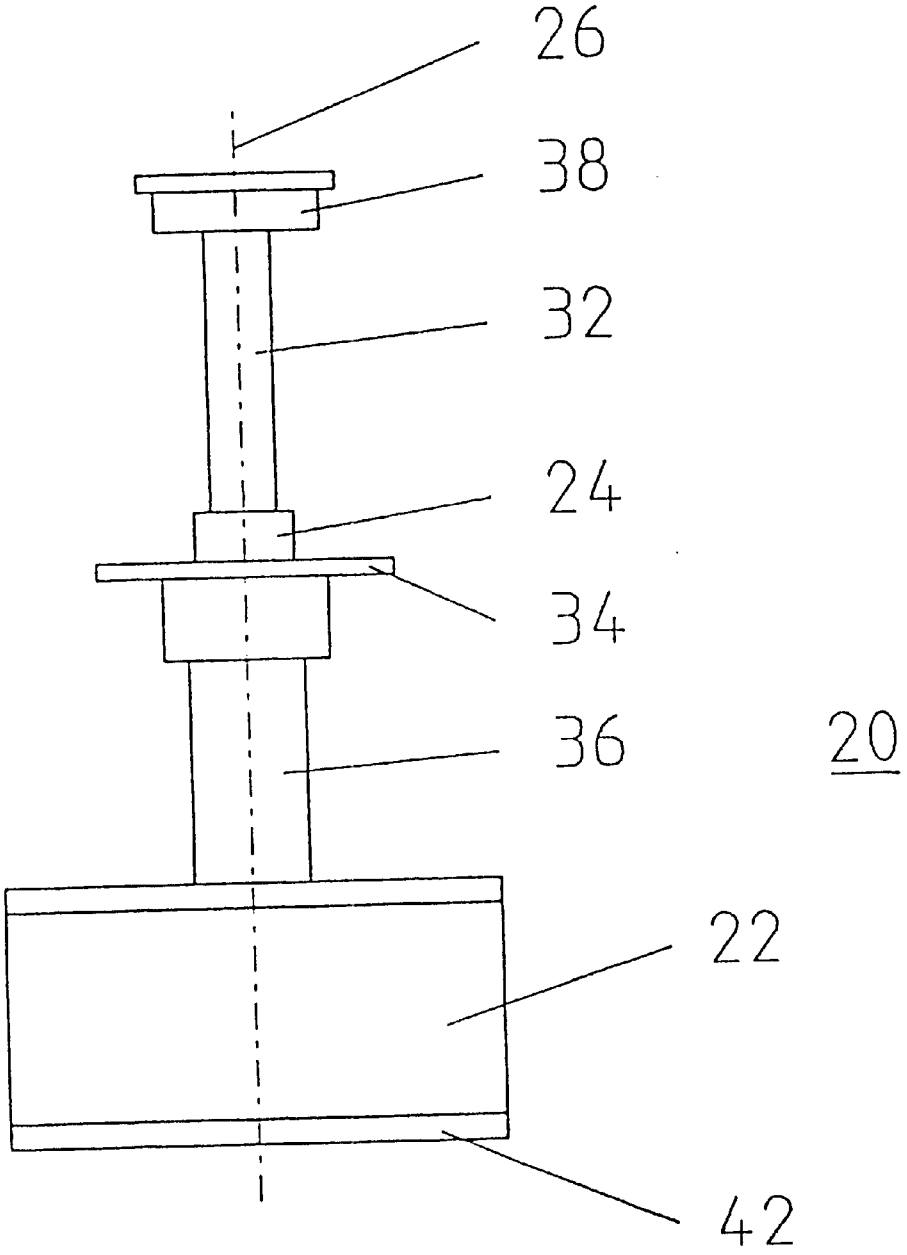
FIG. 2, a motor/gear unit with an integrated holder for a light source.

FIG. 2 shows a lateral view of the drive 20 with the integrated holder 32 for the light source 30.

The drive 20 consists of the motor/gear unit 22, which is embodied as an electric motor (operating voltage preferably 220 V), and which attains a rotating speed of approximately 6 rpm.

The driveshaft 24 extends along the axis of rotation 26 and a flange 34 is arranged on its end, on which the body 12 is fastened. It is provided for this purpose that at least one opening is cut into the surface 14 of the body 12, which has such a diameter that the light source 30 with the holding element 32 and the shaft 24 can be passed through it. The flange 34 has such a diameter that sufficient seating surface for the surface 14 of the body is available, so that the surface 14 can be screwed together with the flange 34 by means of screws. A protective tube 36 is provided for protecting the shaft 24, which extends coaxially with the shaft 24. A seal can be arranged between the flange 34 and the surface 14. In addition, further opening for condensed moisture can be cut in the area of the flange 34.

It becomes clear from FIG. 2, that the holding element 32 is designed as a support pipe, which is arranged in the interior of the shaft 24, also designed as a pipe. A socket 38 for receiving the light source 30 is attached at the end of the support element 32. Electrical feed lines for the light source 30 extend in the interior of the tube 32, or respectively also in the interior of the shaft 24.

For protecting the entire drive unit 20, it can be surrounded by a protective device in the shape of a cylinder. An underside 42 of the motor/gear unit 20 is rigidly connected with the holding device 16.

Figure 3:
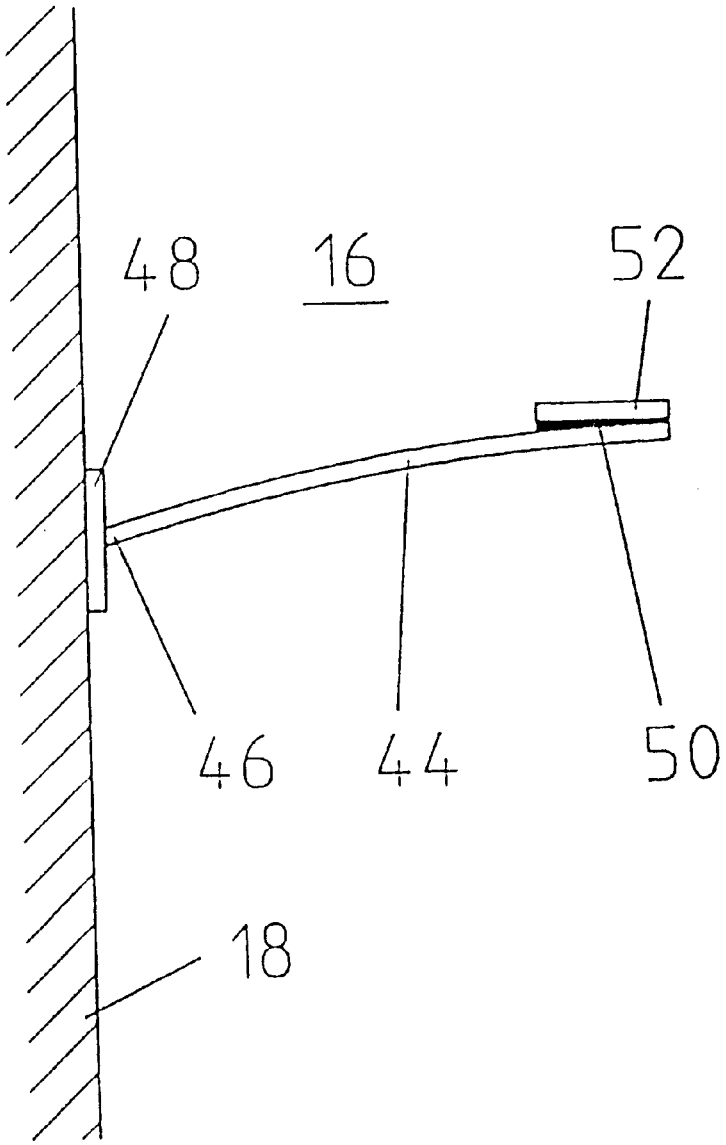
FIG. 3, a holding device for the presentation device in FIG. 1.

A first embodiment of a holding device 16 is represented in FIG. 3. In accordance with this, the holding device 16 consists of a curved steel tube 44, on whose one end 46 a fastening plate 48, preferably a round plate, is fastened, for example welded to it, which can be fastened on the brickwork 18 by means of bolt connections. A receiving plate 52 is fastened, for example welded, to the other end 50 of the steel tube 44, which is also a disk-shaped plate which has essentially the same diameter as the underside 42 of the motor/gear unit 22. The drive 20 is connected by means of screw connections with the receiving plate 52. The body 12 as a whole is arranged in such a way that the axis of rotation 26 extends essentially parallel with the brickwork 13.

Figure 4:
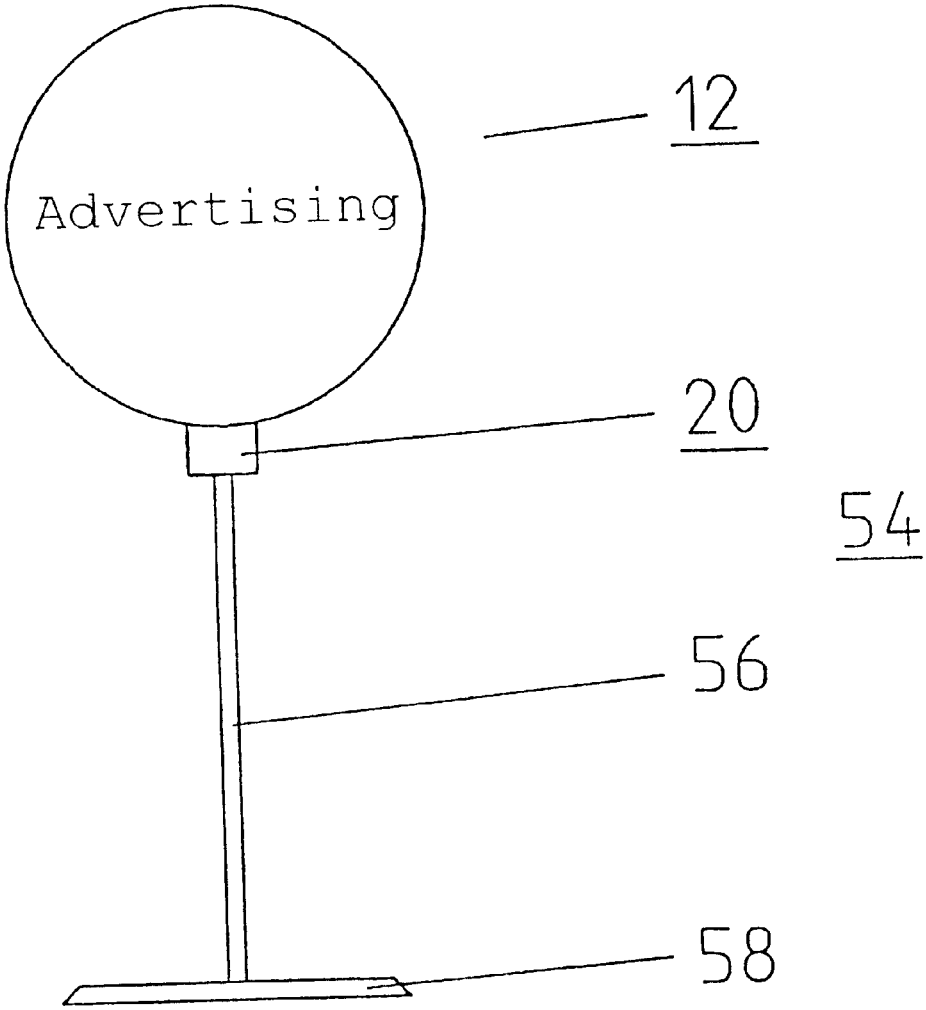
FIG. 4, a further embodiment of the presentation device.

An alternative embodiment of a device 54 for presenting information and advertisements is represented in a lateral view in FIG. 4. Here, the already mentioned advertising body 12' is supported in the manner of a floor lamp via the already described drive 20' by means of a stand 56, which from a foot element 58 resting flat on the ground. The electrical feed lines for the drive 20' extend in the interior of the stand 56, which is embodied as a metal or plastic tube.

What is claimed is:

1. A device (10) for presenting information comprising a body (12) having an interior (28) and a center and being drivable around an axis of rotation (26) by a drive (20) and having a surface (14) for displaying information, and a light source (30) is arranged in the interior (28) of the body (12), wherein a drive shaft (24) of the drive (20) extends along the axis of rotation (26), and, for the even illumination of the surface (14) displaying the information, the light source (30) is arranged on the axis of rotation (26) in the center of the body (12) and, the drive (20) comprises a motor/gear unit (22) which includes the driveshaft (24) extending from the motor/gear unit (22), and includes a flange (34) for connection to the body (12), and a holder (32) for the light source (30) extending coaxially with the driveshaft (24), and through an opening in the body (12) into the interior (28) of the body (12), and, wherein the holder (32) for the light source (30) comprises a tube fixed inside the driveshaft (24).

2. The device in accordance with claim 1, wherein the body (12) is a thin-walled hollow sphere, and the light source (30) comprises a point-shaped light source.

3. The device in accordance with claim 2, wherein the body (12) comprises a transparent plastic material.

4. The device in accordance with claim 2 wherein the driveshaft (24) is surrounded by a protective tube (36).

5. The device in accordance with claim 1 wherein the light source (30) is received in a socket (38) arranged at the end of the holder (32), and is supplied with electrical energy via wiper contacts.

6. The device in accordance with claim 1 wherein the motor/gear unit (20) has two directions of rotation and rotates at about 6 rpm.

7. The device in accordance with claim 1 comprising a holding device (16, 56) including a wall-mounted holder (16) which includes a curved support (44) extending from a fastening plate (48), and a horizontally extending receiving plate (52) is mounted on said curved support for supporting the motor/gear unit (22), the axis of rotation (26) of said motor/gear unit (22) extending vertically.

8. The device in accordance with claim 1 comprising a holding device (16, 56) including a vertically extending support pipe (56), having a bottom end with a solid foot (58) for resting on a support and a top end on which a receiving plate for the motor/gear unit (20') is mounted.

9. The device in accordance with claim 1 wherein the information comprises advertising texts and/or advertising graphics.

* * * * *